US007661666B2

(12) United States Patent
Terao et al.

(10) Patent No.: US 7,661,666 B2
(45) Date of Patent: Feb. 16, 2010

(54) SHEET PROCESSING APPARATUS AND SHEET PROCESSING METHOD

(75) Inventors: Yasunobu Terao, Shizuoka-ken (JP); Hajime Yamamoto, Shizuoka-ken (JP); Yoshiaki Sugizaki, Shizuoki-ken (JP); Takahiro Kawaguchi, Shizuoka-ken (JP); Hiroyuki Taki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 422 days.

(21) Appl. No.: 11/531,935

(22) Filed: Sep. 14, 2006

(65) Prior Publication Data

US 2007/0065204 A1 Mar. 22, 2007

(30) Foreign Application Priority Data

Sep. 21, 2005 (JP) ..... 2005-274279
Sep. 21, 2005 (JP) ..... 2005-274280

(51) Int. Cl.
*B65H 37/04* (2006.01)

(52) U.S. Cl. ..... 270/58.12; 270/58.07; 270/58.08; 270/58.11; 270/58.17; 270/58.27

(58) Field of Classification Search ..... 270/58.01, 270/58.07, 58.08, 58.09, 58.11, 58.12, 58.17, 270/58.27

See application file for complete search history.

(56) References Cited

U.S. PATENT DOCUMENTS 5,478,062 A * 12/1995 Horiuchi et al. ..... 270/58.08
5,590,871 A * 1/1997 Okabe et al. ..... 270/58.27
5,622,359 A * 4/1997 Kawano et al. ..... 270/58.12

FOREIGN PATENT DOCUMENTS

JP 10-291723 11/1998

* cited by examiner

*Primary Examiner*—Gene Crawford
*Assistant Examiner*—Leslie A Nicholson, III
(74) *Attorney, Agent, or Firm*—Turocy & Watson, LLP

(57) ABSTRACT

A sheet processing apparatus having a sheet post-processing unit for performing a post process such as aligning or binding sheets. The sheet processing apparatus is composed of a tray for supporting a sheet bundle, an auxiliary conveying unit including a first arm for hooking an end of the sheet bundle on the tray for moving the first arm, thereby conveying the sheet bundle to a predetermined position on the tray, and returning the first arm from the predetermined position to a home position, and a main conveying unit having a second arm for taking over the sheet bundle from the first arm at the predetermined position on the tray and hooking an end of the sheet bundle for moving the second arm, conveying the sheet bundle taken over, and discharging it from the tray.

10 Claims, 7 Drawing Sheets

SHEET PROCESSING APPARATUS AND SHEET PROCESSING METHOD

CROSS-REFERENCE TO RELATED APPLICATION

This application is based upon and claims the benefit of priority from the prior Japanese Patent Applications No. 2005-274279 filed on Sep. 21, 2005 and No. 2005-274280 filed on Sep. 21, 2005, the entire contents of which are incorporated herein by reference.

BACKGROUND OF THE INVENTION

1. Field of the Invention

The present invention relates to a sheet processing apparatus having a conveying unit for performing a post process such as aligning or binding sheets on a processing tray and discharging an obtained sheet bundle to a paper receiving tray and a sheet processing method.

2. Description of the Related Art

In U.S. Pat. No. 5,385,340, a sheet post-processing apparatus is described. The apparatus stacks and stores a plurality of sheets with images recorded, which are sent from an image forming apparatus, on a processing tray which is a fixed loading section, staples the rear ends of the sheets, and forms a sheet bundle. Thereafter, the stopper plate strikes the sheet bundle and furthermore, the stopper plate moves and presses out the sheet bundle from the processing tray onto the storing tray. In this apparatus, the stopper plate is positioned firstly at the rear end of the processing tray and aligns the rear ends of sheets sent from the image forming apparatus. When sheets of the selection number are stacked on the processing tray, the stapling unit operates and staples the rear ends of sheets, and the stopper plate starts movement and conveys the sheet bundle.

On the other hand, in this kind of apparatus, originally, the stopper plate presses out the sheet bundle to the storing tray, that is, the sheets to be post-processed next are received by the processing tray, thus the processing efficiency can be improved conveniently. However, in the art aforementioned, before the stopper plate presses out the sheet bundle to the storing tray and then returns to the original home position, the stopper plate moves back and forth on the processing tray, so that the sheets to be post-processed next cannot be received by the processing tray and a long period of waiting time is necessary.

Therefore, the applicant develops the aforementioned art, thus the sheet bundle post-processed is sent to the middle part of the processing tray by the first arm and from the middle part, the second arm takes over conveyance of the sheet bundle and discharges it to the storing tray. The applicant contrives a constitution that the first arm is returned to the original home position while the second arm takes over and conveys the sheet bundle. Therefore, the return distance of the first arm can be shortened and the standby status of the next sheets can be set in a short time. During stacking sheets on the processing tray, the second arm may return to the initial position after passing the portion on the opposite side of the processing tray.

In this case, the processing time can be shortened more than that of the aforementioned art, though the first arm and second arm perform separate operations, so that it is necessary to individually prepare and connect drive sources and drive units, thus there is a fear that part expenses may be increased and the cost may be influenced adversely. Particularly, it is necessary to rotate the drive source of the first arm forward and backward and move the first arm back and forth along the processing tray. To shorten the return time, the speed can be controlled, though the control system will be complicated. Furthermore, the unit itself is inevitably made larger and when loading it in the housing of the apparatus, a problem arises that the mounting space is increased.

SUMMARY OF THE INVENTION

The present invention was developed with the foregoing in view and is intended to provide a sheet processing apparatus for receiving sheets to be processed in a shorter time by the processing tray, thereby shortening the processing time.

To accomplish the above object, there is provide a sheet processing apparatus having a sheet post-processing unit for performing a post process such as aligning or binding sheets comprising a tray to support a sheet bundle; an auxiliary conveying unit including a first arm to hook an end of the sheet bundle on the tray to move the first arm, thereby conveying the sheet bundle to a predetermined position on the tray, and return the first arm from the predetermined position to a home position; and a main conveying unit having a second arm to take over the sheet bundle from the first arm at the predetermined position on the tray and hook an end of the sheet bundle to move the second arm, convey the sheet bundle taken over, and discharge the sheet bundle from the tray.

Further, there is provided a sheet processing method having a sheet post-processing unit for performing a post process such as aligning or binding sheets comprising: supporting a sheet bundle on a support means; hooking by a first arm an end of the supported sheet bundle; conveying by the first arm the sheet bundle to a predetermined position on the support means; returning the first arm from the predetermined position to a home position; taking over by a second arm the sheet bundle from the first arm at the predetermined position on the support means; hooking by the second arm an end of the sheet bundle; and conveying the sheet bundle taken over to discharge the sheet bundle from the support means.

DETAILED DESCRIPTION OF THE EMBODIMENTS

Hereinafter, the embodiments of the present invention will be explained in detail with reference to the accompanying drawings.

Figure 1:
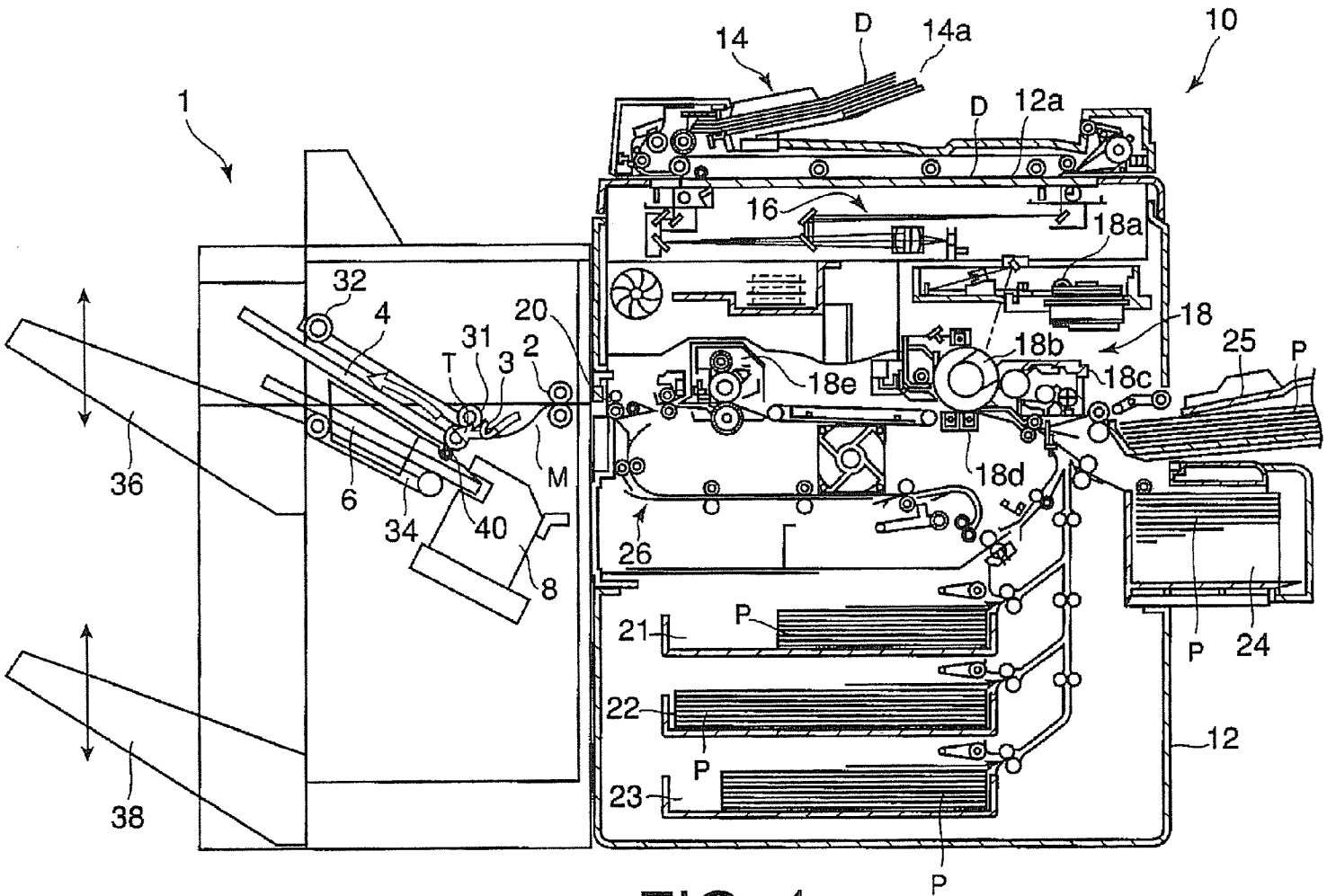
FIG. 1 is a schematic block diagram showing the digital copying machine having a sheet post-processing apparatus relating to an embodiment of the present invention.

FIG. 1 is a schematic diagram of sheet post-processing apparatus 1 functioning as a sheet processing apparatus relating to an embodiment of the present invention and copying machine 10 which is an image forming apparatus to which sheet post-processing apparatus 1 is connected. Copying machine 10 has housing 12 which is a shell of the apparatus and on the top of housing 12, document table 12*a* composed of a transparent glass plate is installed. Above document table 12*a*, automatic document feeder 14 (hereinafter, referred to as just ADF 14) is installed in openable and closable. ADF 14 operates so as to automatically send document D to a predetermined position on document table 12*a*.

For example, documents D are set on paper supply tray 14*a* of ADF 14 and existence of the stapling process, how to perform the stapling process, the number of copies, and paper size are set by the control panel. When the copy start switch is pressed after the setting, documents D on paper supply tray 14*a* are automatically supplied one by one to the document reading position on document table 12*a* and after the documents are read, are automatically discharged at appropriate timing. Inside housing 12, scanner unit 16, printer unit 18, and cassettes 21, 22, and 23 for storing papers P with different sizes are arranged. On the right wall of housing 12 in the drawing, large volume paper feeder 24 storing a large amount of papers with the same size and manual paper feed tray 25 are attached. Furthermore, to the left wall of housing 12 in the drawing, sheet post-processing apparatus 1 which will be described later is connected.

Scanner unit 16 lights up and scans documents D supplied to the document reading position on document table 12*a* by ADF 14, reads and converts photo-electrically the reflected light, and obtains image information of documents D. Printer unit 18 energizes laser exposing device 18*a* on the basis of the image information read by scanner unit 16 and forms an electrostatic latent image based on the image information on the peripheral surface of photo-conductive drum 18*b*. Printer unit 18 supplies and visualizes toner to the electrostatic latent image on photo-conductive drum 18*b* via developing device 18*c* and transfers the toner image onto paper P by transfer charger 18*d*.

At this time, paper P is supplied from any of cassettes 21, 22, and 23, large volume paper feeder 24, and manual paper feed tray 25. Furthermore, printer unit 18 supplies paper P to which the toner image is transferred to fixing device 18*e*, heats and melts the toner image, fixes it on paper P, and discharges it to sheet post-processing apparatus 1 via discharging port 20. Paper P discharged via discharging port 20 conforms to sheet M explained in the embodiment of the present invention. Further, after passing fixing device 18*e*, paper P requiring duplex copy is conveyed to converting path 26, is turned upside down, and is sent again into the fixing area between photo-conductive drum 18*b* and fixing device 18*e*.

On the other hand, sheet post-processing apparatus 1 stacks and aligns image-formed papers, that is, sheets M discharged via discharging port 20 of copying machine 10 in a unit of the designated number of sheets merged and bound and perform the stapling process which is a post process. The stapling process is referred to as a process of aligning and binding one ends of a plurality of sheets M stacked. Sheet post-processing apparatus 1 has entrance roller 2 and entrance sensor 3 at the position opposite to discharging port 20 of copying machine 10. Entrance sensor 3 detects passing of the front end and rear end of sheet M sent to sheet post-processing apparatus 1 via entrance roller 2 in the sending direction indicated arrow T in the drawing.

Sheet post-processing apparatus 1 includes queuing tray 4 for stacking sheets M of the number sent in the direction of arrow T via entrance roller 2 to stand by, processing tray 6 for receiving sheets M dropped from queuing tray 4 and aligning the rear ends thereof for the stapling process, and stapler 8 which is a sheet post-processing unit for stapling the rear ends of sheets M stacked and aligned by processing tray 6. Queuing tray 4 and processing tray 6 are installed so as to be inclined upward in the sending direction of sheets M. In other words, queuing tray 4 and processing tray 6 are inclined downward toward the rear ends of sheets M. The stapling process by stapler 8 requires a fixed period of processing time, so that during the stapling process of sheets M on processing tray 6, it is necessary to make sheets M in unit of the designated number of sheets to be bound next stand by at another location.

In this embodiment, during the stapling process for preceding sheets M in unit of the designated number, among sheets M to be processed next, two sheets M stand by on queuing tray 4, thus the period of time for stapling preceding sheets M in unit of the designated number is ensured. Namely, first sheet M and second sheet M which are sent in the direction of arrow T are stacked on queuing tray 4 to stand by. And, after end of the stapling process in unit of the preceding designated number of sheets, two sheets M standing by on queuing tray 4 are dropped onto processing tray 6. Third and subsequent sheets M all pass queuing tray 4 and are stacked directly on processing tray 6.

Figure 2:
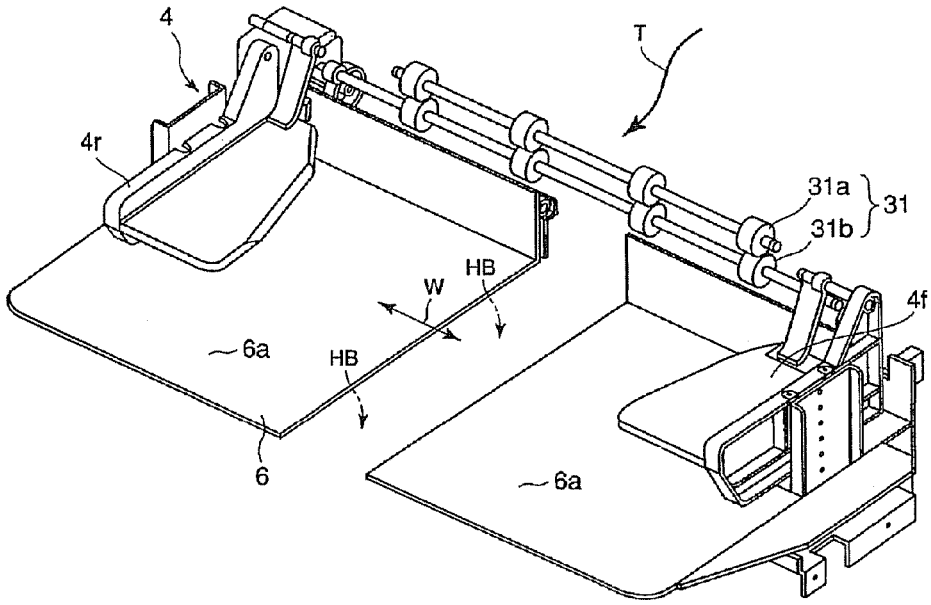
FIG. 2 is a schematic perspective view of the queuing tray and processing tray relating to the same embodiment.

FIG. 2 is a drawing schematically showing queuing tray 4 and processing tray 6. Queuing tray 4 has two open/close trays 4*r* and 4*f* for opening and closing in the direction (the direction of arrow w in the drawing) (hereinafter, this direction is referred to as "width direction W") crossing sending direction T of sheets M. Open/close trays 4*r* and 4*f*, for example, are connected to a motor via a rack pinion unit not drawn and perform an open/close operation synchronously with each other between the support position for supporting the neighborhood of the rear end corner of sheet M sent in sending direction T in the sending direction and the release position for releasing the support. When open/close trays 4*r* and 4*f* are opened to the release position, sheets M stacked are dropped onto processing tray 6. At this time, the width of the opening formed between two open/close trays 4*r* and 4*f* is widened toward the upstream side in the sending direction. Therefore, when open/close trays 4*r* and 4*f* are opened, the rear ends of sheets M stacked in the sending direction are dropped firstly onto processing tray 6.

Both queuing tray 4 and processing tray 6 are inclined downward toward the rear side, so that when sheets M are dropped from queuing tray 4 onto processing tray 6, sheets M are pressed so as to slightly move on the rear end side. On the upstream side of queuing tray 4 in the sending direction, as shown also in FIG. 1, paper feed roller 31 for clamping sheets M sent in sending direction T indicated by the arrow and feeding them to queuing tray 4 is installed. Paper feed roller 31 has a plurality of upper roller 31*a* and lower roller 31*b* facing each other. Paper feed roller 31 is controlled so as to start rotation using the detection of passing of the front end of sheet M in sending direction T by entrance sensor 3 as a trigger and stop the rotation using the detection of passing of the rear end of concerned sheet M in sending direction T by entrance sensor 3 as a trigger.

On the downstream side of queuing tray 4 in sending direction T, queuing tray roller 32 is installed (shown only in FIG. 1 and omitted in FIG. 2). Queuing tray roller 32 is arranged in contact with/separate from the sheet placing surface of queuing tray 4 and can rotate forward and backward. Namely, sheets M sent to queuing tray 4 are rotated backward to convey slightly in the opposite direction of sending direction T and reposition and sheets M requiring no stapling process are stacked on queuing tray 4 and then are rotated forward to discharge toward paper receiving trays 36 and 38. Paper receiving trays 36 and 38 can move vertically in accordance with a processed object.

Figure 3:
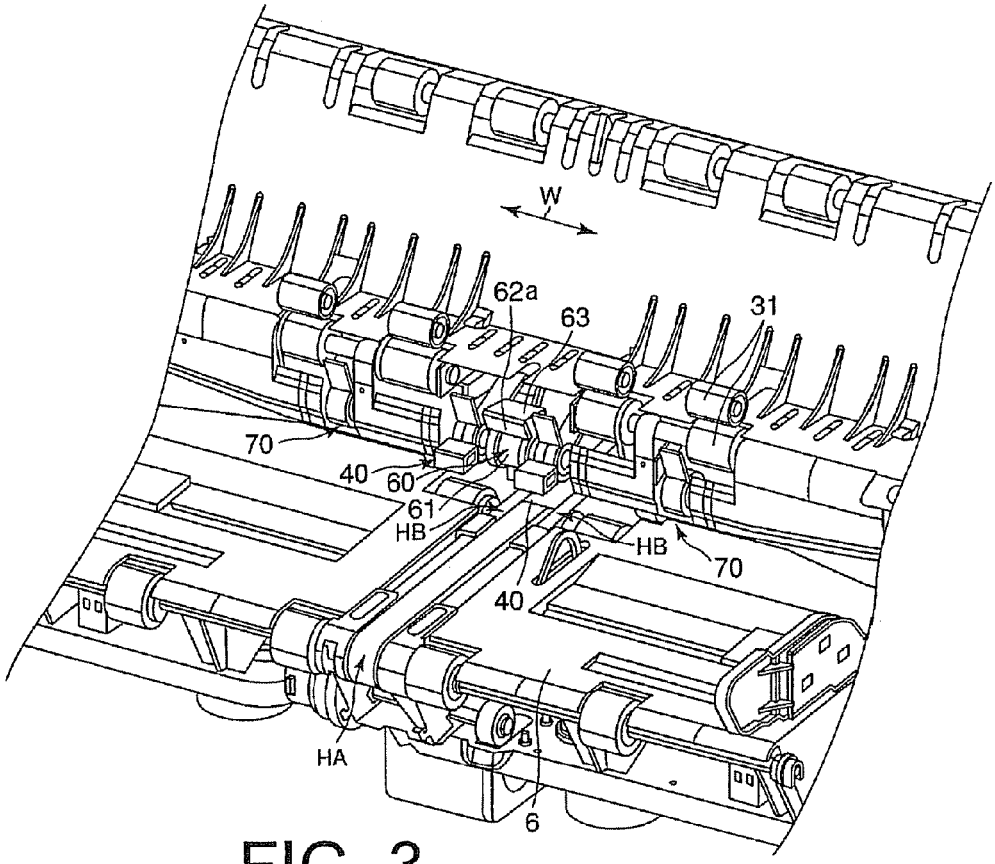
FIG. 3 is a perspective view of a part of the essential section relating to the same embodiment.

Processing tray 6 has flat sheet placing surface 6*a* for loading and stacking sheets M dropped from queuing tray 4. The central part of processing tray 6 in width direction W, as described later, has main conveying unit HA and auxiliary conveying unit HB (not drawn in FIG. 2) for conveying sheets M post processed toward paper receiving trays 36 and 38. To expose the conveying surfaces of sheets M of main conveying unit HA and auxiliary conveying unit HB from sheet placing surface 6*a*, processing tray 6 is divided horizontally into two parts except the central part. FIG. 3 is a perspective view showing a part of sheet post-processing apparatus 1 composed of sending member 40, pressing member 60, auxiliary sending member 70, main conveying unit HA, and auxiliary conveying unit HB (for a part of the components, the numerals are omitted or not drawn). Firstly, sending member 40, pressing member 60, and auxiliary sending member 70 will be explained schematically. Extending in width direction W at the position neighboring with paper feed roller 31, the rotary shaft connected to the drive unit is supported flexibly. Pressing member 60 is installed at the central part of the rotary shaft, and a pair of sending members 40 are installed horizontally on both sides, and auxiliary sending members 70 are installed outside respective sending members 40.

Pressing member 60 includes a flexibly supporting portion rotatably supported by the rotary shaft, a pressing portion projected from a part of the peripheral surface of the flexibly supporting portion with a rubber material adhered overall, and a guide portion folded and formed integrally with the front edge of the pressing portion having a curved section, while pressing portion 62 has a flat section. In the neighboring portion of pressing member 60, an electromagnetic solenoid is arranged and a connection unit is installed between the electromagnetic solenoid and pressing member 60. According to the control for the electromagnetic solenoid, pressing member 60 is energized to rotate via the connection unit. Sending member 40 includes a receiver for receiving the rear ends of sheets M sent to queuing tray 4 in sending direction T, a slapping portion for slapping downward the rear ends of sheets M received by the receiver, a paddle for scraping and sending sheets M dropped on processing tray 6 on the upstream side which is downward, and a rotor to which the rear ends of the receiver, slapping portion, and paddle are integrally attached and which is fit into the rotary shaft.

Figure 4A:
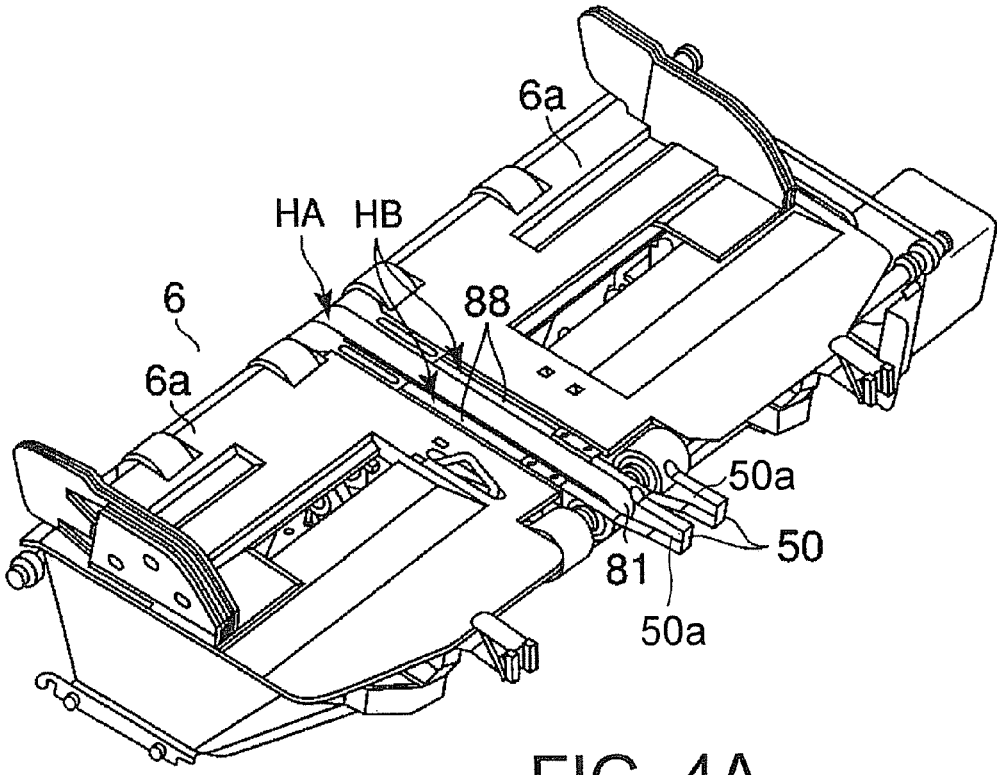
FIGS. 4A and 4B are perspective views showing different conditions of the main conveying unit and auxiliary conveying unit of the processing tray relating to the same embodiment.
Figure 4B:
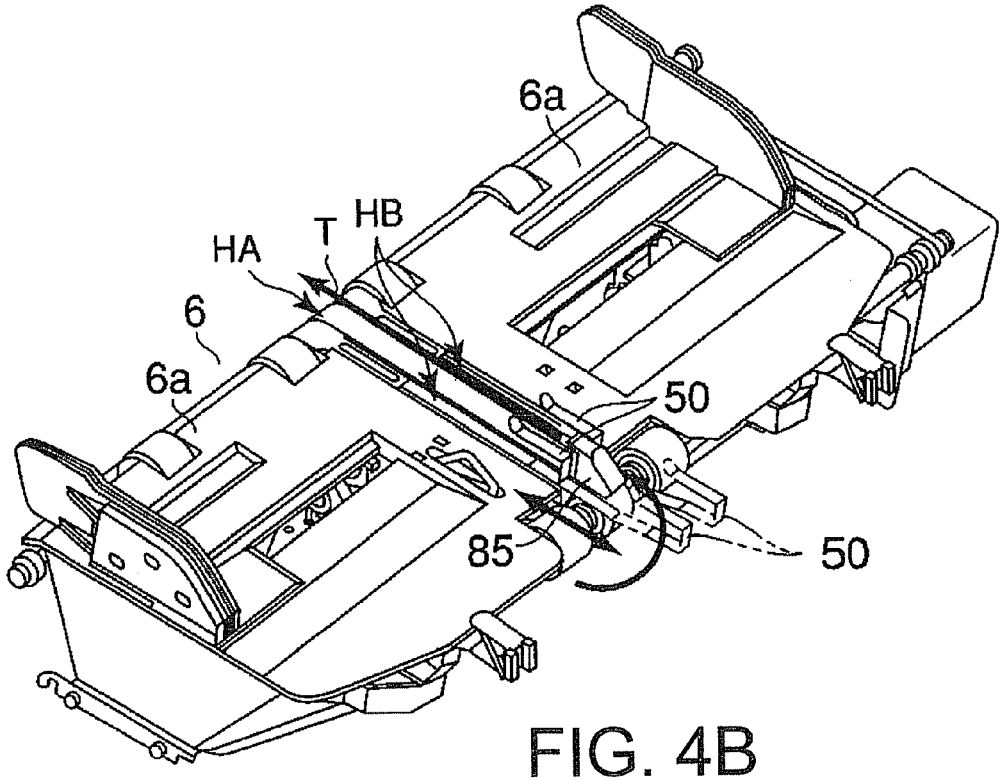
Figure 5:
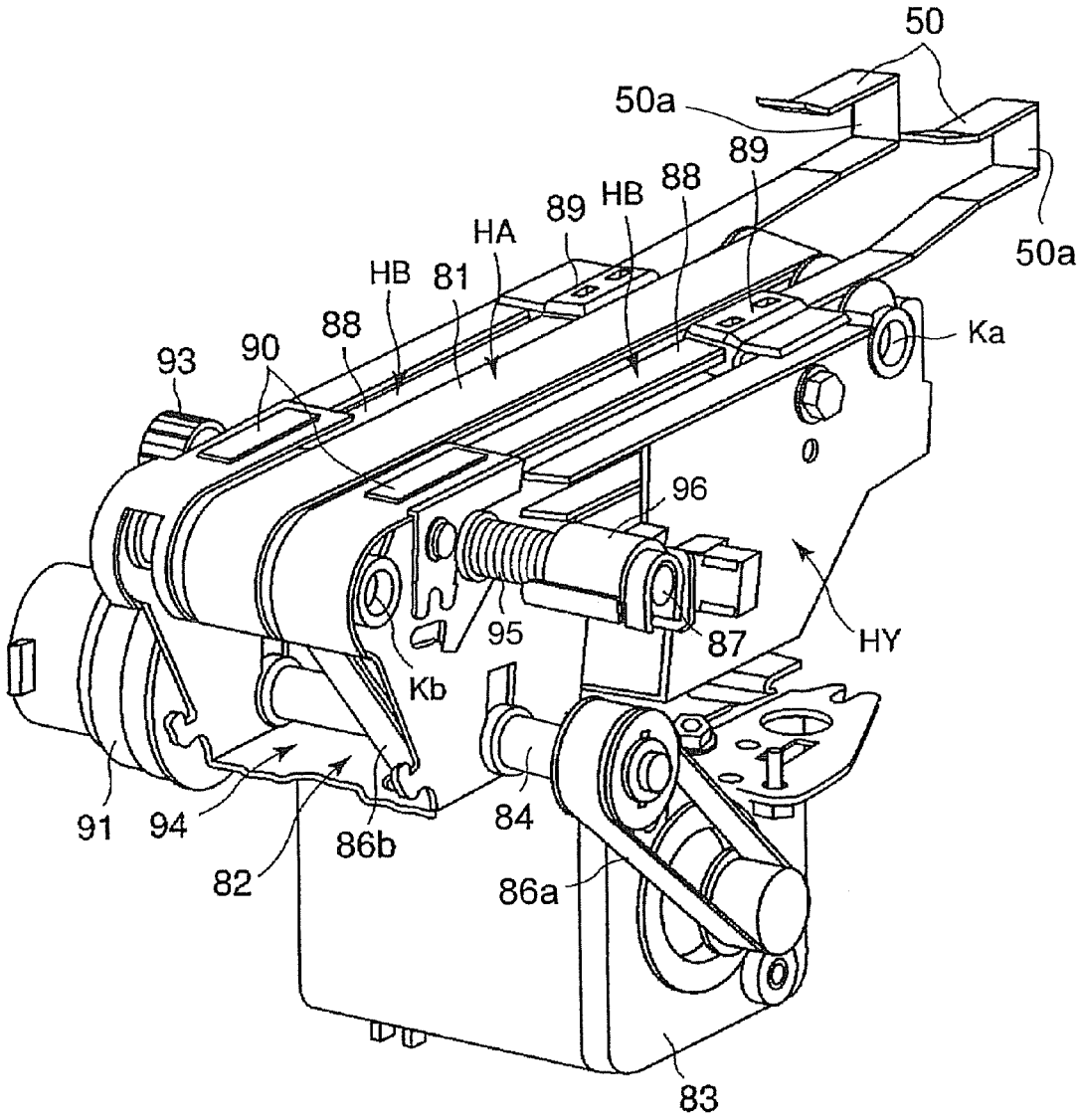
FIG. 5 is a perspective view showing the main conveying unit and auxiliary conveying unit relating to the same embodiment.
Figure 6:
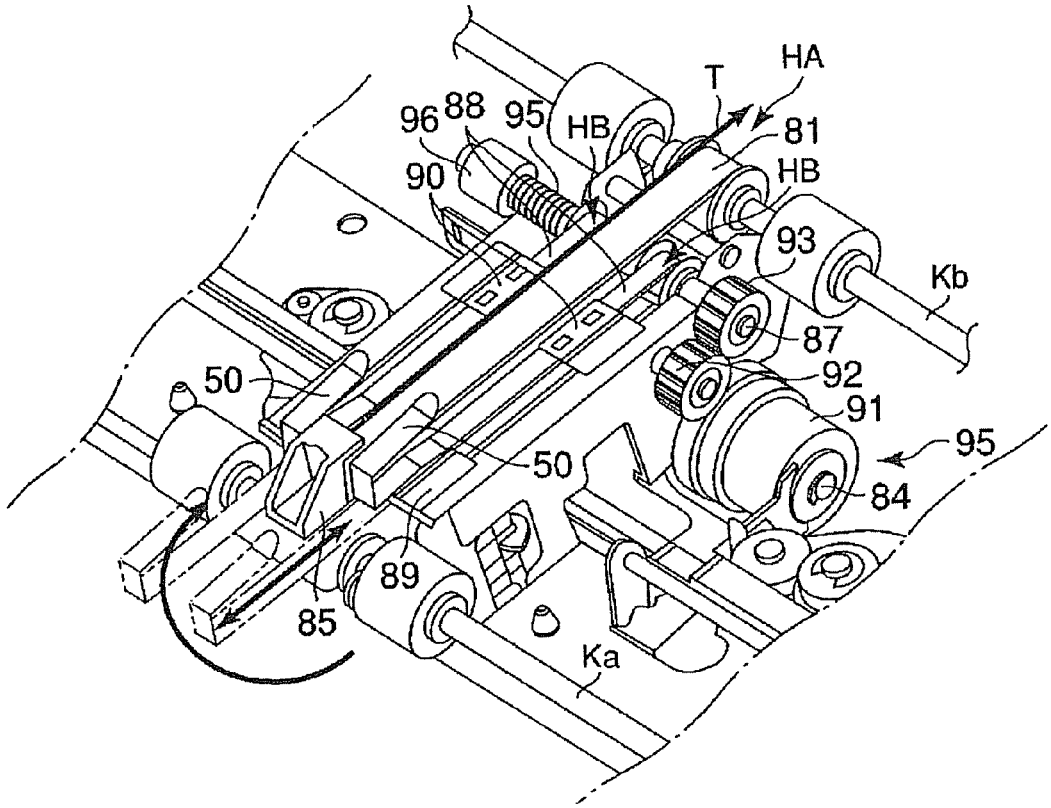
FIG. 6 is a perspective view showing the main conveying unit and auxiliary conveying unit when the processing tray is removed relating to the same embodiment.

Auxiliary sending member 70 is composed of the rotor fit and fixed to the rotary shaft and an auxiliary slapping portion installed on the rotor. The position of the auxiliary slapping portion for the rotary shaft of auxiliary sending member 70 and the position of the slapping portion for the rotary shaft of sending member 40 are set exactly at the same angle. Next, main conveying unit HA and auxiliary conveying unit HB will be described in detail. FIGS. 4A and 4B are perspective views of processing tray 6 and main conveying unit HA and auxiliary conveying unit HB exposed on sheet placing surface 6*a* of processing tray 6, which are in different conditions from each other. FIG. 5 is a perspective view of unit structure HY having main conveying unit HA and auxiliary conveying unit HB and FIG. 6 is a perspective view of main conveying unit HA and auxiliary conveying unit HB when processing tray 6 is removed.

Main conveying unit HA will be explained first. At the upstream side end and downstream side end of processing tray 6 in sending direction T, rotary shafts Ka and Kb are installed almost extending in the width direction. Pulleys are fit and fixed to respective rotary shafts Ka and Kb and belt 81 is stretched between these pulleys. One rotary shaft Kb is connected to drive source 83 via drive unit 82 which will be described later, and belt 81 is exposed on sheet placing surface 6*a* of processing tray 6 and can move endlessly along facing surface 6*a*. Particularly, as shown in FIGS. 4B and 6, on a part of belt 81, second arm 85 with the same width as that of belt 81 is installed integrally. In second arm 85, when it is projected from sheet placing surface 6*a* of processing tray 6, so as to be opened toward the downstream side in sending direction T, the section is formed almost in a U shape. Further, on the lower side of belt 81, there are no obstacles caused to moving of second arm 85.

Particularly as shown in FIG. 5, main conveying unit HA and auxiliary conveying unit HB are unified so as to form unit structure HY. To the bottom of unit structure HY, drive motor 83 which is the aforementioned drive source is attached. A pulley is fit into the rotary shaft of drive motor 83 and between it and a pulley installed on spindles 84 which will be described later, drive belt 86*a* is stretched. Spindles 84 are installed in parallel with each other in the neighborhood of rotary shaft Kb on the downstream side in sending direction T and also inside unit structure HY of spindles 84, a pulley is fit. Furthermore, a pulley is installed on rotary shaft Kb on the downstream side and between it and the pulley of spindles 84, driven belt 86*b* is stretched. In this way, drive unit 82 of main conveying unit HA is structured. The rotary drive force of drive motor 83 is transferred to belt 81 stretched in parallel with sheet placing surface 6*a* of processing tray 6 via drive unit 82 having two steps of belts 86*a* and 86*b*.

Auxiliary conveying unit HB has pulleys on both sides of main conveying unit HA attached to rotary shaft Ka at the end on the upstream side in sending direction T and has a pulley, which will be described later, installed in the neighborhood of rotary shaft Kb at the end on the downstream side in sending direction T. On these pulleys, belt 88 is stretched. Belt 88 is also exposed on sheet placing surface 6*a* of processing tray 6 and can move endlessly along facing surface 6*a*. On a part of belt 88, first arm 50 with the same width as that of belt 88 is installed via attachment tool 89. First arm 50 is a piece formed in almost the same width as that of belt 88 and has hook portion 50*a* folded and formed almost in a U shape so as to be opened toward the downstream side in the sending direction.

FIGS. 4A and 5 show the status that first arm 50 is at the home position. Namely, first arm 50 waits for stacking of sheets M to be post-processed on processing tray 6. At this time, the base end (the portion attached to belt 88 via attachment tool 89) of first arm 50 is positioned in the neighborhood of rotary shaft Ka on the upstream side in sending direction T and the front end thereof in an almost U shape is projected from belt 88 in the direction toward the upstream side. First arm 50 ahead attachment tool 89 is formed almost linearly and belt 88 is extended straight. Therefore, with respect to sheets M led to processing tray 6, the rear ends thereof are put on the front end in an almost U shape of first arm 50 and a part thereof is projected on the side of processing tray 6. Further, the front end of first arm 50 is aligned at the same position as that of stapler 8.

A pair of belts 88 composing auxiliary conveying unit HB is installed on both sides across belt 81 composing main conveying unit HA. Therefore, second arm 85 installed on belt 81 of main conveying unit HA is positioned between first arms 50 installed on the pair of belts 88 of auxiliary conveying unit HB.

Figure 10:
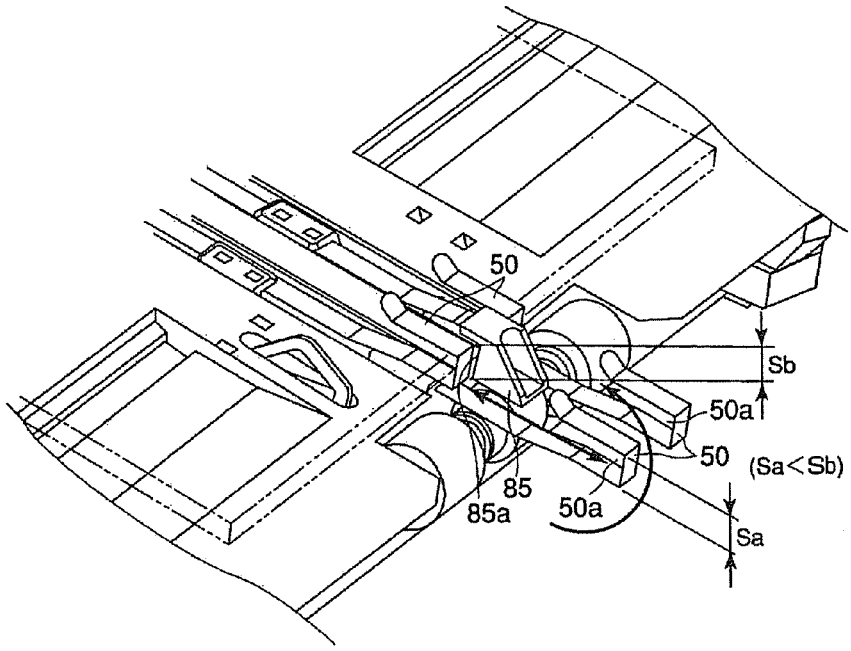
FIG. 10 is a perspective view for explaining the shapes and structures of the first arm and second arm and the height of the hook portion relating to the same embodiment.

Particularly as shown in FIG. 10, height Sa of hook portions 50*a* of first arms 50 is set lower than height Sb of hook portion 85*a* of second arm 85 (Sa<Sb).

For belts 88 of auxiliary conveying unit HB, in the neighborhood of rotary shaft Kb on the downstream side in sending direction T, stoppers 90 are installed across the tops of belts 88. When belts 88 travel and first arms 50 move from the home positions, stoppers 90 finally collide with attachment tools 89 for attaching and fixing first arms 50 to belts 88, thus the additional movement of first arms 50 and belts 88 is controlled. On the other hand, at the end of spindle 84 into which both pulleys of drive belt 86*a* and driven belt 86*b* are fit, electromagnetic clutch 91 which is a clutch body is installed. Drive gear 92 flexibly supported by unit structure HY meshes with the output portion of electromagnetic clutch 91 and drive gear 92 meshes with driven gear 93 installed on spindle 87 of auxiliary conveying unit HB.

Drive unit 94 of auxiliary conveying unit HB is structured in this way and the drive force of drive motor 83 is transferred to electromagnetic clutch 91 from drive belt 86*a*. Furthermore, it is transferred to spindle 87 from electromagnetic clutch 91 via gears 92 and 93 and drives the pair of belts 88 to travel simultaneously. Electromagnetic clutch 91, according to a control signal, transfers the drive force of drive motor 83 to belts 88 or interrupts the drive force not to transfer it to belts 88. Particularly as shown in FIGS. 5 and 6, in spindle 87 on the downstream side in sending direction T, the end thereof on the opposite side of the end with which driven gear 93 meshes is projected from unit structure HY. Round the projection, torsion coil spring 95 which is an elastic body is wound and a part of torsion coil spring 95 is covered with holding member 96.

Figure 7:
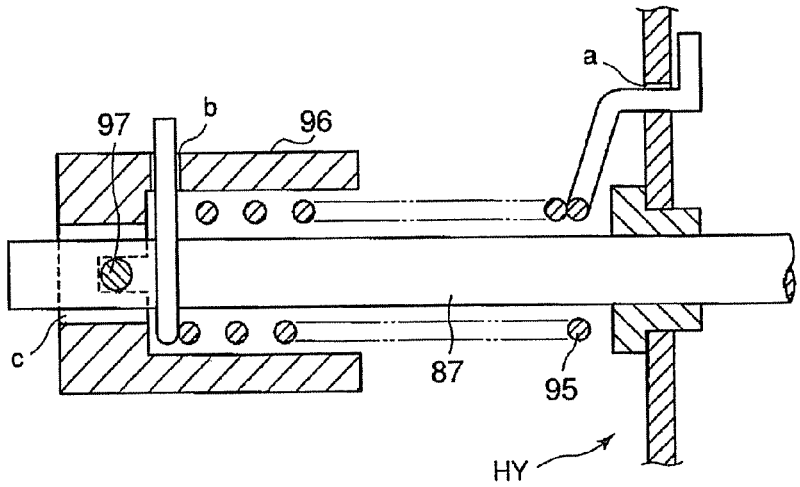
FIG. 7 is a cross sectional view for explaining the holding member of the auxiliary conveying unit relating to the same embodiment.

FIG. 7 is a drawing for explaining the form of torsion coil spring 95 for spindle 87 and holding member 96. One end of torsion coil spring 95 is hooked by hole a formed in unit structure HY and the other end is hooked by holding member 96. Holding member 96 has a circular section, that is, is in a cylindrical shape, has an inside diameter formed larger than the outside diameter of torsion coil spring 95, thereby covers a part of or the greater part of torsion coil spring 95. At the end of holding member 96, hole b passing from the inside diameter to the outside diameter is formed and the other end of torsion coil spring 95 is inserted through it and is hooked. And, hole c inserted through along the shaft center is formed and the end of spindle 87 is inserted through it. On the insertion portion, pin 97 is installed in the radial direction, and pin 97 passes through spindle 87 and holding member 96 and fixes the position of holding member 96 to spindle 87.

Next, the operation of sheet post-processing apparatus 1 will be explained. First sheet M is sent to sheet post-processing apparatus 1 from copying machine 10 and sheet M is fed toward queuing tray 4. At this time, pressing member 60 does not interrupt sheet M to be fed. Both sides of sheet M in the transverse direction are put on queuing tray 4 and the rear end of sheet M is put on receivers 4*r* and 4*f*. Queuing tray 4 and the receiver are inclined upward in the sending direction and sheet M is pressed so as to move on the rear end side by its own weight. The width of the opening between open/close trays 4*r* and 4*f* composing queuing tray 4 is widened toward the rear end of sheet M, so that the central part of the rear end hangs down by its own weight and this part is received by the receiver.

At this time, second arm 85 of main conveying unit HA is positioned on the lower side of belt 81 and is not exposed on sheet placing surface 6*a* of processing tray 6. First arm 50 of auxiliary conveying unit HB is positioned at the end of the base end on the upstream side in the sending direction of belts 88 and the front end thereof is projected more on the upstream side. Further, as described above, the position of the front end in a U shape of first arm 50 coincides with the mounting position of stapler 8. Pressing member 60 rotates in exact timing, and the pressing portion is put on the top of the rear end of sheet M and clamps the rear end of sheet M in cooperation with the receiver. Thereafter, second sheet M is sent to queuing tray 4 across pressing member 60 and is stacked on first sheet M. The rear end of first sheet M is clamped, so that even if the front end of second sheet M collides with first sheet M or even if it slides and moves on first sheet M, the posture of first sheet M is not broken and second sheet M is stacked normally.

When second sheet M is put on first sheet M, the rear end of second sheet M makes contact with the front end of the guide portion. Therefore, second sheet M is supported in the state that it is shifted from first sheet M on the downstream side in the sending direction, thus it is shifted forward from the rear end of first sheet M. Next, open/close trays 4*r* and 4*f* composing queuing tray 4 are moved and opened outside in the transverse direction and sending member 40 is driven to rotate. The receiver separates from the rear end of first sheet M and releases the support and the slapping portion rotates and slaps the rear end of second sheet M. Simultaneously, auxiliary sending member 70 operates and auxiliary slapping portion slaps the rear ends of two sheets M. Both sheets M are dropped onto processing tray 6. At this time, there is nothing under the pressing portion for pressing first sheet M, so that when the support by the receiver is eliminated, the rear end of sheet M becomes free perfectly. The rear end of second sheet M is positioned forward the pressing portion, so that the pressing portion does not interrupt it and two sheets M are put smoothly on processing tray 6.

Furthermore, sending member 40 continues rotation and the slapping portion separates from sheets M, while the paddle makes contact with upper sheet M. The paddle is made of an elastic material and makes contact with second sheet M, is deformed elastically, and scrapes and sends second sheet M toward first arm 50 by the frictional force, that is, in the rotational direction. The rear end of second sheet M is shifted and stacked forward from the rear end of first sheet M, and the scraping and sending force of the paddle mainly acts on second sheet M, so that by restoring the shift from first sheet M, the rear ends of two sheets M can be aligned perfectly with first arm 50.

Figure 8:
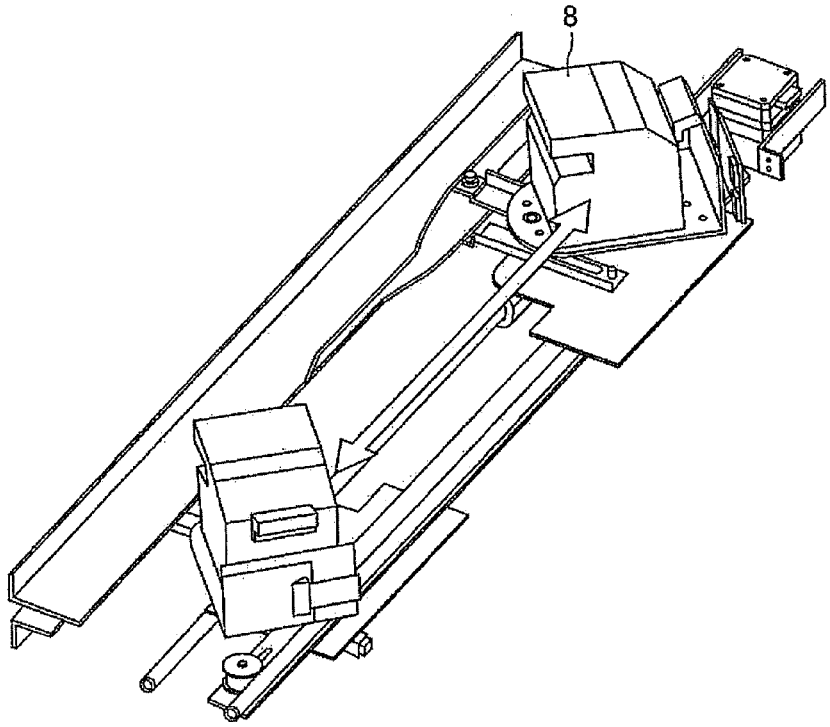
FIG. 8 is a perspective view for explaining the operation of the stapler relating to the same embodiment.

Open/close trays 4*r* and 4*f* composing queuing tray 4 are kept in the open state and third and subsequent sheets M of the designated number are directly sent to processing tray 6 and are sequentially put on two sheets M with the rear ends aligned. Immediately after sheets M are put on processing tray 6, in exact timing, the paddle scrapes and sends them toward first arm 50. Processing tray 6 itself is inclined upward in the sending direction, so that the rear ends of all the sheets are aligned. When designated sheets M are all put on processing tray 6 with the rear ends aligned in this way, as shown in FIG. 8, stapler 8 installed so as to move along the rear ends of sheets M moves to a predetermined stapling position and binds sheets M. At this time, so as to prevent first arm from colliding with stapler 8, the shape, structure, and mounting position of first arm 50 are taken into account.

Figure 9A:
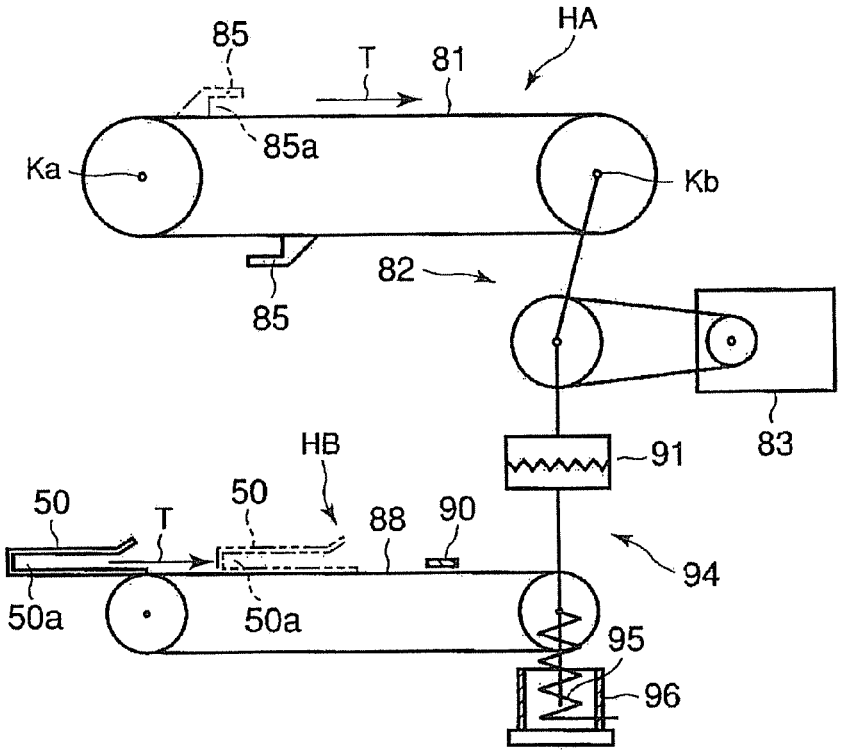
FIGS. 9A and 9B are schematic views for explaining sequentially the schematic constitutions and operations of the main conveying unit and auxiliary conveying unit relating to the same embodiment.
Figure 9B:
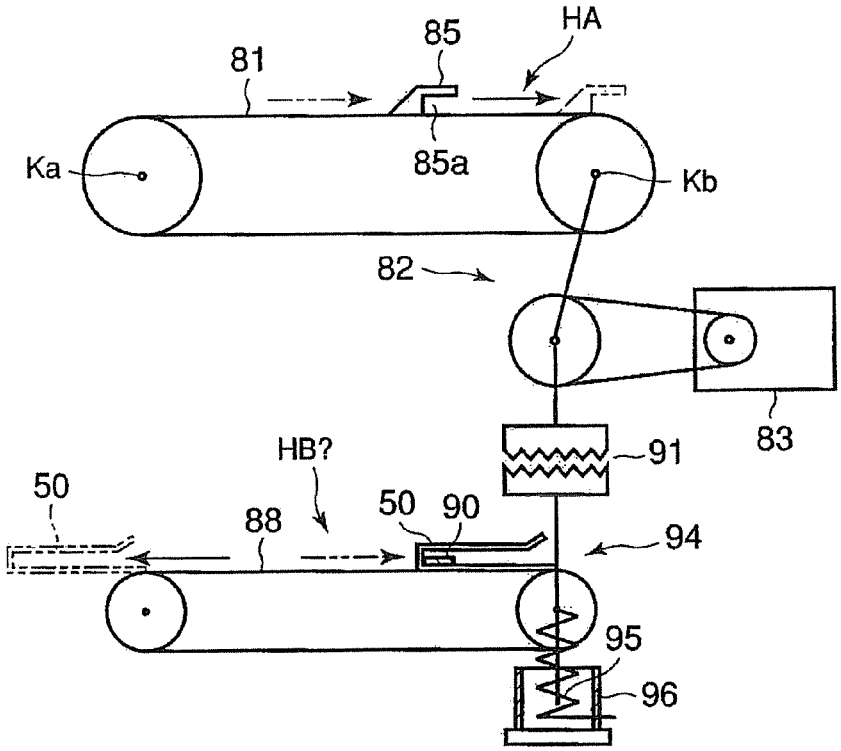

FIGS. 9A and 9B are drawings schematically showing the constitutions and operations of main conveying unit HA and auxiliary conveying unit HB. Actually, the units are inclined upward in sending direction T, though here, they are shown horizontally. Further, sheets M and processing tray 6 are not drawn. While sheets M are stacked on processing tray 6 and the post process of binding the rear ends thereof is performed, drive motor 83 is stopped and second arm 85 of main conveying unit HA is positioned on the lower side of belt 81 and is not exposed on sheet placing surface 6*a* of processing tray 6. Therefore, even if two sheets M are dropped from queuing tray 4 onto processing tray 6 and even if third and subsequent sheets M are directly led to processing tray 6, second arm 85 causes no obstacles to sheets M.

On the other hand, in first arm 50 of auxiliary conveying unit HB, the front end in a U shape is projected on the upstream side in sending direction T and is opened on the downstream side. Moreover, processing tray 6 is inclined upward and the paddle performs the scraping operation, so that the front end in a U shape aligns and hooks the rear ends of sheets M. As shown in FIG. 9A, upon receipt of a signal indicating end of the post process for sheets M, drive motor 83 is driven, and the drive force is transferred to belt 81 via drive unit 82 of main conveying unit HA, and belt 81 starts travel in sending direction T of the arrow shown in the drawing. In auxiliary conveying unit HB, electromagnetic clutch 91 is in the connection state, and the drive force of drive motor 83 is transferred via drive unit 94, and belt 88 starts travel in sending direction T of the arrow shown in the drawing.

Sheet bundle M stacked on processing tray 6 is on belts 81 and 88 composing main conveying unit HA and auxiliary conveying unit HB and are hooked by a pair of first arms 50. Actually, the rear end of sheet bundle M is hooked by the front end in a U shape of first arm 50, and the other part is put on attachment tool 89 for attaching first arm 50 to belt 81, and there exists a narrow gap between it and the main surfaces of belts 81 and 88 of main conveying unit HA and auxiliary conveying unit HB. Therefore, sheet bundle M is conveyed by first arm 50 and is independent of travel of belt 81 of main conveying unit HA. Simultaneously, in main conveying unit HA, second arm 85 performs position movement of moving from the lower side of belt 81 to the upper side thereof.

Together with processing tray 6, belts 81 and 88 of main conveying unit HA and auxiliary conveying unit HB are inclined upward in sending direction T, though sheet bundle M is conveyed in the state that the rear end thereof is hooked by the front end in a U shape of first arm 50, so that sheet bundle M will not slide down in the opposite direction of sending direction T. Furthermore, when first arm 50 moves and reaches the predetermined position indicated by the two-dot chain line in the drawing, second arm 85 also reaches the same predetermined position indicated by the two-dot chain line in the drawing. The condition that the positions of second arm 85 and first arm 50 are aligned in this way is shown in FIGS. 4B and 6. Therefore, at the rear end of sheet bundle M, first arm 50 and second arm 85 are hooked and sheet bundle M is conveyed by these arms. The portions in contact with sheet bundle M increase and sheet bundle M can be conveyed in a stable state.

Further, as explained in FIG. 10, height Sa of hook portion 50*a* of first arm 50 is set lower than height Sb of hook portion 85*a* of second arm 85 (Sa<Sb). Therefore, even if the hook position of hook portion 85*a* of second arm. 85 is a portion where the thickness other than the stapling portion is expanded, sheet bundle M is hooked free of obstacles and is transferred surely.

Simultaneously, in correspondence to the rotation of spindle 87 of auxiliary conveying unit HB, holding member 96 for hooking one end of torsion coil spring 95 rotates and the other end of torsion coil spring 95 is hooked by unit structure HY, so that the position is not changed. In torsion coil spring 95, the diameter is controlled so as to be sequentially made smaller, thus the elastic force is accumulated. As shown in FIG. 9B, when first arm 50 moves, it is stopped by stopper 90 installed across belt 88. Actually, attachment tool 89 for attaching the base end of first arm 50 to belt 88 collides with stopper 90. Upon receipt of a signal of this collision, it is sent to electromagnetic clutch 91 and the clutch enters the disconnection state and belt 88 of auxiliary conveying unit HB stops movement.

With respect to the stop position of first arm 50, on processing tray 6, almost the greater part of sheet bundle M is conveyed and only a short distance is left. Drive motor 83 drives continuously, and belt 81 of main conveying unit HA travels straight, and only second arm 85 conveys sheet bundle M. Immediately after it, second arm 85 reaches the end of processing tray 6 on the downstream side in the sending direction and discharges sheet bundle M during conveyance to paper receiving tray 36 or 38. On the other hand, in auxiliary conveying unit HB, electromagnetic clutch 91 enters the disconnection state, thus the rotational drive force to spindle 87 is removed. Therefore, torsion coil spring 95 wound round spindle 87 to suppress the diameter thereof discharges the accumulated elastic force at a stretch. Spindle 87 is inversely driven rapidly by the operation of torsion coil spring 95 and belt 88 is driven to travel at a rapid speed in the opposite direction of the preceding traveling direction.

At least one part of torsion coil spring 95 is covered with cylindrical holding member 96. Therefore, not only when the diameter of torsion coil spring 95 is suppressed in correspondence to the rotation of spindle 87 but also when the accumulated elastic force is discharged at a stretch and the diameter is enlarged, holding member 96 controls the external form of torsion coil spring 95. Namely, at least one part of torsion coil spring 95 is covered with cylindrical holding member 96, thus vibration is prevented and the load can be stabilized.

By the operation of torsion coil spring 95, first arm 50 passes the predetermined position aligned before with the position of second arm 85 and returns rapidly toward it original home position. Attachment tool 89 of first arm 50 collides with a stopper not drawn and stops and belt 81 stops the movement. While only second arm 85 conveys sheet bundle M and discharges it to paper receiving tray 36 or 38, by the operation of the elastic recovery force of torsion coil spring 95, first arm 50 can be returned almost instantaneously to the home position shown in FIG. 9A.

Before second arm 85 of main conveying unit HA returns again to the home position shown in FIG. 9A, drive motor 83 operates continuously and during the period, electromagnetic clutch 91 continues the disconnection state. Therefore, on sheet placing surface 6*a* of processing tray 6, second arm 85 does not exist and first arm 50 is at the standby position, so that sheets M to be post-processed next can be stacked on processing tray 6.

According to the present invention, first arm 50 conveys sheet bundle M to the predetermined position of processing tray 6 and returns it to the home position from the position. At the predetermined position, second arm 85 takes over the conveyance and discharges sheet bundle M from processing tray 6. While second arm 85 discharges sheet bundle M, first arm 50 is structured so as to return to the home position.

Therefore, immediately after sheet bundle M post-processed is discharged from processing tray 6, sheets M to be post-processed next can be received by processing tray 6 and there is little waiting time. Shortening of the processing time and improvement of the processing efficiency can be realized extremely advantageously.

Further, in the present invention, using drive motor 83 which is a single drive source, both main conveying unit HA and auxiliary conveying unit HB are driven, so that the part expenses can be lowered, and the effect on the cost is suppressed to the minimum, and the mechanism can be miniaturized, and the arrangement space is reduced, thus the apparatus itself can be made compact. Almost at the greater part of the distance of processing tray 6, second arm 85 of main conveying unit HA and first arm 50 of auxiliary conveying unit HB convey sheet bundle M, so that the conveying posture for sheet bundle M is held stably and an occurrence of inclination is suppressed surely.

The movement of returning of first arm 50 from the predetermined position to the original home position is performed by combination of electromagnetic clutch 91 with elastic body 95, so that particularly the drive source for giving the return drive force and drive unit are not necessary and the part expenses can be lowered by a simple constitution. The elastic recovery force of elastic body 95 is discharged at a stretch, and first arm 50 can be returned to the home position almost instantaneously, and during the period, second arm 85 discharges sheet bundle M to paper receiving trays 36 and 38. Therefore, immediately after discharging sheet bundle M post processed from processing tray 6, sheets M to be post processed next can be received by processing tray 6 and there is little waiting time. Shortening of the processing time and improvement of the processing efficiency can be realized extremely advantageously.

Torsion coil spring 95 is used as an elastic body, so that a sure operation can be performed in a minimum mounting space. For example, when a tension spring is used as an elastic body, the space in correspondence with expansion and contraction of the tension spring must be ensured and the miniaturization is suppressed in correspondence to it. On the other hand, for torsion coil spring 95, only the space in correspondence to the change in the radial direction may be ensured. Furthermore, at least one part of torsion coil spring 95 is covered with cylindrical holding member 96 for controlling the external form of the coil. Namely, the external form of torsion coil spring 95 is controlled by holding member 96, thus vibration is prevented, and the load can be stabilized. Concretely, the stable load can withstand a large transformation (large angle) of the spring. When the aforementioned is summarized, according to the present invention, a comparatively simple constitution realizing shortening of the processing time is obtained.

Furthermore, auxiliary conveying unit HB having first arm 50 is arranged along both sides of main conveying unit HA having second arm 85 and second arm 85 is positioned between a pair of first arms 50.

In other words, firstly, the pair of first arms 50 convey sheet bundle M and are in the separated positions, thereby can convey sheet bundle M in a stable state free of an occurrence of inclination of sheet bundle M. Halfway, second arm joins and conveys sheet bundle M together with first arms 50, though the position of second arm 85 is set between first arms 50, so that the conveying posture is stabilized more and the conveying reliability is improved.

First arm 50 is returned to the home position from the predetermined position and here, only second arm 85 takes over the conveyance and discharges sheet bundle M from processing tray 6. Second arm 85 conveys actually sheet bundle M at an extremely short distance on processing tray and the position of second arm 85 is the central part for sheet bundle M between first arms 50, so that there is no room for sheet bundle M during conveyance to generate inclination and the conveyance reliability is improved.

Furthermore, height Sa of hook portions 50*a* of first arms 50 is set lower than height Sb of hook portion 85*a* of second arm 85 (Sa<Sb). Therefore, even if the hook position of hook portion 85*a* of second arm 85 is the stapling portion or others, sheet bundle M is bundled free of obstacles and is transferred surly, and the conveyance reliability is improved.

Further, in the embodiments aforementioned, a case that sheets M composed of papers with recorded images formed on are aligned and stapled is explained. However, the present invention is not limited to it and may be applied to an apparatus for aligning other sheets such as postal matter or banknotes. Further, the present invention is not limited straight to the aforementioned embodiments, and at the execution stage, within a range which is not deviated from the objects of the present invention, the components can be modified and materialized, and by appropriate combination of a plurality components disclosed in the embodiments aforementioned, various inventions can be formed.

What is claimed is:

1. A sheet processing apparatus having a sheet post-processing unit for performing a post process such as aligning or binding sheets comprising:

a tray to support a sheet bundle;

an auxiliary conveying unit including a first arm to hook an end of the sheet bundle on the tray to move the first arm, thereby conveying the sheet bundle to a predetermined position on the tray, and return the first arm from the predetermined position to a home position;

a main conveying unit having a second arm to take over the sheet bundle from the first arm at the predetermined position on the tray and hook an end of the sheet bundle to move the second arm, convey the sheet bundle taken over, and discharge the sheet bundle from the tray;

a single drive source connected to the auxiliary conveying unit and main conveying unit to drive the auxiliary conveying unit and main conveying unit;

a clutch body installed between the drive source and the auxiliary conveying unit to transfer drive force of the drive source to the auxiliary conveying unit before the first arm reaches the predetermined position as a taking-over position from the main conveying unit and interrupt the drive force for the auxiliary conveying unit when the first arm reaches the predetermined position; and an elastic body joined to the auxiliary conveying unit and deformed elastically during transfer of the drive force to the auxiliary conveying unit by the clutch body to act elastic recovery force when the drive force is interrupted, thereby returning the first arm to the home position.

2. The apparatus of claim 1, wherein the elastic body is a torsion coil spring.

3. The apparatus of claim 2 further comprising:

a cylindrical holding member to cover at least one part of the torsion coil spring and control a transformation condition of an external form of the coil.

4. The apparatus of claim 1, wherein the auxiliary conveying unit has a pair of first arms, and the pair of arms are arranged along both sides of the main conveying unit, and the second arm is positioned between the pair of first arms.

5. The apparatus of claim 1, wherein height Sa of a hook portion to hook the sheet bundle of the first arm is set lower than height Sb of a hook portion to hook the sheet bundle of the second arm (Sa<Sb).

6. A sheet processing apparatus having a sheet post-processing unit for performing a post process such as aligning or binding sheets comprising:

support means for supporting a sheet bundle;

auxiliary conveying means including a first arm for hooking an end of the sheet bundle on the support means for moving the first arm, conveying the sheet bundle to a predetermined position on the support means, and returning the first arm from the predetermined position to a home position;

main conveying means having a second arm for taking over the sheet bundle from the first arm at the predetermined position on the support means and hooking an end of the sheet bundle for moving the second arm, conveying the sheet bundle taken over, and discharging the sheet bundle from the support means;

a single drive source connected to the auxiliary conveying means and main conveying means for driving the auxiliary conveying means and main conveying means;

a clutch body installed between the drive source and the auxiliary conveying means for transferring drive force of the drive source to the auxiliary conveying means before the first arm reaches the predetermined position as a taking over position from the main conveying means and interrupting the drive force for the auxiliary conveying means when the first arm reaches the predetermined position; and an elastic body joined to the auxiliary conveying means and deformed elastically during transfer of the drive force to the auxiliary conveying means by the clutch body for acting elastic recovery force when the drive force is interrupted, thereby returning the first arm to the home position.

7. The apparatus of claim 6, wherein the elastic body is a torsion coil spring.

8. The apparatus of claim 7 further comprising:

a cylindrical holding member for covering at least one part of the torsion coil spring and controlling a transformation condition of an external form of the coil.

9. The apparatus of claim 6, wherein the first arm of the auxiliary conveying means includes a pair of first arms, and the pair of arms are arranged along both sides of the main conveying means, and the second arm is positioned between the pair of first arms.

10. The apparatus of claim 6, wherein height Sa of a hook portion for hooking the sheet bundle of the first arm is set lower than height Sb of a hook portion for hooking the sheet bundle of the second arm (Sa<Sb).

* * * * *

UNITED STATES PATENT AND TRADEMARK OFFICE

CERTIFICATE OF CORRECTION

PATENT NO. : 7,661,666 B2
APPLICATION NO. : 11/531935
DATED : February 16, 2010
INVENTOR(S) : Terao et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 577 days.

Signed and Sealed this

Fourth Day of January, 2011

David J. Kappos

David J. Kappos
*Director of the United States Patent and Trademark Office*